US011161225B2

(12) United States Patent
Prescott

(10) Patent No.: US 11,161,225 B2
(45) Date of Patent: Nov. 2, 2021

(54) STANDPIPE OPERATIONS SPANNER TOOL

(71) Applicant: David Prescott, Boca Raton, FL (US)

(72) Inventor: David Prescott, Boca Raton, FL (US)

( * ) Notice: Subject to any disclaimer, the term of this patent is extended or adjusted under 35 U.S.C. 154(b) by 0 days.

(21) Appl. No.: 17/065,280

(22) Filed: Oct. 7, 2020

(65) Prior Publication Data

US 2021/0122013 A1 Apr. 29, 2021

Related U.S. Application Data

(60) Provisional application No. 62/926,220, filed on Oct. 25, 2019.

(51) Int. Cl.
*B25B 13/50* (2006.01)
*B25F 1/00* (2006.01)

(52) U.S. Cl.
CPC ..... *B25B 13/5058* (2013.01); *B25B 13/5033* (2013.01); *B25F 1/00* (2013.01)

(58) Field of Classification Search
CPC ..... B25B 13/12; B25B 13/46; B25B 13/48; B25B 13/50; B25B 13/5058; B25B 13/16; B25B 13/18; B25B 13/5033; B25F 1/00
See application file for complete search history.

(56) References Cited

U.S. PATENT DOCUMENTS 151,635 A * 6/1874 Uhlinger ..... B25B 13/04 81/124.3
1,465,009 A * 8/1923 Wasseth ..... B25F 1/006 81/437
1,609,507 A * 12/1926 Bucciarelli ..... B25B 13/16 81/94
2,605,665 A * 8/1952 Grenat ..... B25F 1/00 81/124.4
5,086,674 A * 2/1992 Her ..... B25B 13/06 7/138
5,247,715 A * 9/1993 Nishiguchi ..... B25B 13/00 7/138
5,303,439 A * 4/1994 Seals ..... B25B 13/56 59/7
5,655,242 A * 8/1997 Chuang ..... B25B 13/04 7/100
6,298,754 B1 * 10/2001 Brown ..... B25B 13/48 7/138
6,502,483 B1 * 1/2003 Swank ..... B25B 13/56 7/138
6,961,973 B1 * 11/2005 Smith ..... B25B 13/14 7/100
6,978,702 B1 * 12/2005 Diggle, III ..... B25B 13/04 81/121.1

(Continued)

*Primary Examiner* — Robert J Scruggs
(74) *Attorney, Agent, or Firm* — The Concept Law Group, PA; Scott D. Smiley; Scott M. Garrett

(57) ABSTRACT

A firefighter multi-tool is configured as a standpipe operations spanner tool and comprises several features for adjusting standpipe pressure regulating valves, and performing other functions performed by firefighters. The tool includes a handle portion and a lateral coupling portion. The lateral coupling portion includes an adjustable wrench having a fixed jaw elements and a moveable/adjustable jaw element. The tool can include a socket portion at the end of the handle opposite the lateral coupling portion. A valve cap spanner can be includes on the lateral coupling portion opposite the adjustable wrench.

18 Claims, 8 Drawing Sheets

(56) References Cited

U.S. PATENT DOCUMENTS

| | | | | |
|---|---|---|---|---|
| 7,698,970 | B1 * | 4/2010 | Chavez | B25B 15/007 81/124.4 |
| 8,113,094 | B1 * | 2/2012 | Brackbill | B25B 15/00 81/138 |
| 9,925,654 | B2 * | 3/2018 | Ragner | B25F 1/04 |
| 2004/0020329 | A1 * | 2/2004 | Boman | B25B 13/06 81/125.1 |
| 2006/0150783 | A1 * | 7/2006 | Thompson | B25B 13/06 81/124.4 |
| 2012/0279362 | A1 * | 11/2012 | Cummings | B25B 13/56 81/57.11 |

* cited by examiner

700

STANDPIPE OPERATIONS SPANNER TOOL

CROSS-REFERENCE

This application is a non-provisional conversion of U.S. provisional application No. 62/926,220, filed Oct. 25, 2019, and claims the benefit of that application, the entirety of which is hereby incorporated by reference.

FIELD OF THE DISCLOSURE

The inventive disclosure relates generally to firefighter tools, and more particularly to an "all-in-one" type of tool for use by firefighters and others who, among other tasks, need to adjust water pressure output at a standpipe valve in buildings where water pressure is sufficiently high to require a pressure regulating valve.

BACKGROUND OF THE DISCLOSURE

Multi-unit and high rise buildings are constructed with standpipes to which fire hoses can be connected. Standpipes are fitted with valves, which include field adjustable pressure reducing valves such as the "URFA" field adjustable pressure reducing valve made by Elkhart Brass Manufacturing Company, Inc. of Elkhart, Ind. Other types of standpipe valves are used commonly, as well, such as, for example, those made by Zurn Industries (e.g. the 3000 series) and Giacomini S.P.A. (e.g. the A200 series). These valves are used to regulate water pressure to specified operating range for firefighting hoses and equipment. Most fire code requirements for standpipe systems are based on recommendations from National Fire Protection Association (NFPA) 14, Standard for the Installation of Standpipe and Hose Systems, and NFPA 13, Standard for the Installation of Sprinkler Systems, respectively. These requirements include the installation of an approved pressure-regulating device any time the static pressure within a standpipe system will exceed 175 psi. When the static pressure at a hose connection exceeds 175 psi, an approved pressure-regulating device shall be provided to limit both static and residual pressures. Furthermore, if flowing pressures exceed 100 psi, then NFPA 14 requires that "an approved device" be installed at the outlet to reduce pressures to a maximum of 100 psi. Pressure-regulating devices, as defined in NFPA 14, "are designed for the purpose of reducing, regulating, controlling, or restricting water pressure in order to limit standpipe system outlet pressure so that firefighters can safely and effectively operate handlines for manual firefighting."

It is common that, once on the scene of a fire in a high rise building, firefighters have to adjust the valve(s) used on standpipes in order to bring the pressure at the standpipe into an appropriate range (e.g. under 175 psi). Since the various valve types use different pressure regulating designs, firefighters typically have to carry tools for each of the commonly used valves. In addition to all the other tools that firefighters have to carry, having to carry separate valve adjustment tools for each different valve type can be an inconvenience. Furthermore, if a firefighter loses a tool, then they cannot make the necessary adjustment.

Therefore, a need exists to overcome the problems with the prior art as discussed above.

SUMMARY OF THE INVENTIVE DISCLOSURE

In accordance with some embodiments of the inventive disclosure, there is provided a standpipe operations spanner tool that includes a body having a proximate end and a distal end opposite the proximate end. The standpipe operations spanner tool further includes a handle formed from the proximate end of the body in a direction towards the distal end, and having a handle axis being defined by the handle. The standpipe operations spanner tool further includes at least one hex socket, located at the proximate end of the body and joined to the handle, that is configured to fit onto a standpipe pressure regulator of a first type. The at least one hex socket is oriented perpendicular to the handle axis. The standpipe operations spanner tool further includes a spanner adjacent the distal end of the body on a first side of the body and having a jaw opening oriented along the body. The standpipe operations spanner tool further includes an adjustable wrench having a jaw opening opposite the spanner on the body, and having a fixed jaw portion adjacent the distal end of the body, and an adjustable jaw portion oriented along the handle axis.

In accordance with a further feature, the spanner is a valve bonnet spanner.

In accordance with a further feature, the spanner is a hose fitting spanner.

In accordance with a further feature, the at least one spanner comprises an adjustable jaw element opposite a fixed jaw element that is located at the distal end.

In accordance with a further feature, the hex socket is oriented is double ended, wherein a first end is first size hex socket and a second end is a second side hex socket.

In accordance with a further feature, the proximate end of the handle is rotatable about the handle axis and the hex socket can be oriented in either of at least two positions about the handle axis.

In accordance with a further feature, the proximate end of the handle includes a cross member having opposing portions, and each one of the opposing portions includes a hex socket of a different size, and wherein the cross member can be rotated about the handle axis to adjust a position of the adjustable jaw element relative to the fixed jaw element.

In accordance with a further feature, the tool further includes an adjustment dowel disposed at the distal end of the handle and that is configured to fit into an adjustment hole of an adjustment ring of a standpipe valve of a second type, and which is oriented along the handle axis.

In accordance with some embodiments of the inventive disclosure, there is provided a firefighter multi-tool having a proximate end and a distal end, with a double-ended socket portion formed at the proximate end of the firefighter tool. The double-ended socket portion includes a first socket at a first end and a second socket at a second end opposite the first end, and has a socket portion axis defined through the double-ended socket portion from the first end to the second end. The tool also includes a handle formed from the double-ended socket section at a side of the double-ended socket section midway between the first end and the second end to a midpoint of the firefighter tool along a handle axis that is perpendicular to the socket portion axis. The handle extends in a direction from the proximate end to the distal end of the firefighter tool. The tool also includes a lateral coupling section including, on a first side of the lateral coupling section, an adjustable spanner having fixed jaw portion adjacent the distal end, and a valve cap spanner opposite adjustable spanner on the lateral coupling section having a first engagement adjacent the distal end.

In accordance with a further feature, there is further provided a fire hydrant nut wrench disposed in the lateral coupling section formed and pentagonal opening through the lateral coupling section between the adjustable spanner and the valve cap spanner.

In accordance with a further feature, the adjustable spanner comprises an elongated threaded member captured by a first boss and a second boss, wherein the elongated threaded member is oriented such that an axis of the elongated threaded member is parallel to the handle axis, an adjustment ring is disposed over the elongated threaded member between the first boss and the second boss.

In accordance with a further feature, there is further provided an adjustment rod disposed in a bore along the handle axis, wherein the bore extends into the handle from the proximate end and through the double-ended socket section.

In accordance with a further feature, there is further provided a pair of hex key extensions that extend outward, perpendicular to an axis of the adjustment rod, at an end of the adjustment rod.

In accordance with a further feature, the double-ended socket portion includes a pair of slots extending from the bore at the proximate end in which the pair of hex key extension fit.

In accordance with some embodiments of the inventive disclosure, there is provided a standpipe operations spanner tool that includes a body having a proximate end and a distal end opposite the proximate end. The body has a socket portion formed at the proximate end and defining a socket portion axis. The socket portion has at least one hex socket oriented in a direction of the socket portion axis. The at least one hex socket is sized to engage an adjustment nut of a standpipe pressure regulating valve. The body has a handle portion formed adjoining the socket portion and extending to a midpoint of the body along a handle axis that is perpendicular to the socket portion axis. The body also has a lateral coupling portion formed adjoining the handle portion at the midpoint and extending to the distal end of the body in a direction of the handle axis and including an adjustable spanner having fixed jaw portion adjacent the distal end of the body.

In accordance with a further feature, the socket portion comprises a first socket at a first end and a second socket at a second end opposite the first end, wherein the socket axis passes through the double-ended socket portion from the first end to the second end.

In accordance with a further feature, the lateral coupling section further comprises a valve cap spanner positioned on the lateral coupling section opposite the adjustable spanner.

In accordance with a further feature, the lateral coupling section further includes a gas valve shut off slot formed through the body between the distal end of the body and the fixed jaw of the adjustable spanner and having a length oriented perpendicular to the handle axis. The lateral coupling portion further includes at least one square hole formed through body between the adjustable spanner and the valve cap spanner. The lateral coupling portion also includes a regular pentagonal socket formed through the body between the adjustable spanner and the valve cap spanner, and between the handle portion and the at least one square hole, the pentagonal socket being sized to fit on a fire hydrant nut.

In accordance with a further feature, there is further provided an adjustment rod removable disposed in a channel running through the socket portion at the proximate end of the body and along the handle axis into the handle portion.

Although the inventive disclosure is illustrated and described herein as embodied in a standpipe and firefighter all-in-one type tool, it is, nevertheless, not intended to be limited to the details shown because various modifications and structural changes may be made therein without departing from the spirit of the inventive disclosure and within the scope and range of equivalents of the claims. Additionally, well-known elements of exemplary embodiments of the inventive disclosure will not be described in detail or will be omitted so as not to obscure the relevant details of the inventive disclosure.

Other features that are considered as characteristic for the invention are set forth in the appended claims. As required, detailed embodiments of the present inventive disclosure are disclosed herein; however, it is to be understood that the disclosed embodiments are merely exemplary of the inventive disclosure, which can be embodied in various forms. Therefore, specific structural and functional details disclosed herein are not to be interpreted as limiting, but merely as a basis for the claims and as a representative basis for teaching one of ordinary skill in the art to variously employ the present inventive disclosure in virtually any appropriately detailed structure. Further, the terms and phrases used herein are not intended to be limiting; but rather, to provide an understandable description of the inventive disclosure. While the specification concludes with claims defining the features of the inventive disclosure that are regarded as novel, it is believed that the inventive disclosure will be better understood from a consideration of the following description in conjunction with the drawing figures, in which like reference numerals are carried forward. The figures of the drawings are not drawn to scale.

Before the present inventive disclosure is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present inventive disclosure, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present inventive disclosure and simplify the description, but not to indicate or imply that the devices or components must have a specific azimuth, or be constructed or operated in the specific azimuth, which thus cannot be understood as a limitation to the embodiments of the present inventive disclosure. Furthermore, terms such as "first", "second", "third" and so on are only used for descriptive purposes, and cannot be construed as indicating or implying relative importance. In the description of the embodiments of the present inventive disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the inventive disclosure.

DETAILED DESCRIPTION

Figure 1:
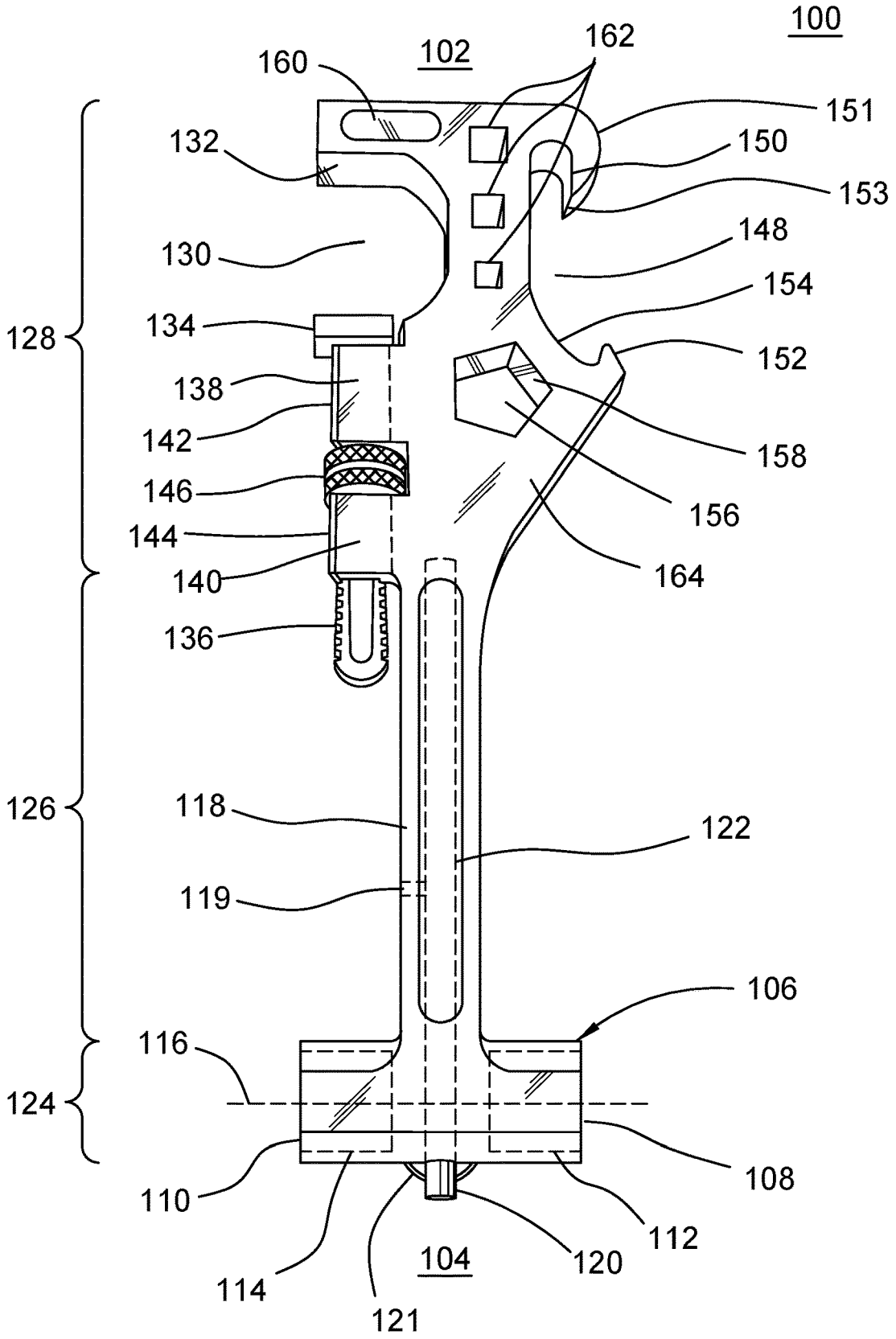
FIG. 1 is a side view of a standpipe operations spanner (SOS) multi-tool including an adjustment dowel in the tail of the SOS tool, in accordance with some embodiments.

While the specification concludes with claims defining the features of the disclosure that are regarded as novel, it is believed that the invention will be better understood from a consideration of the following description in conjunction with the drawing figures, in which like reference numerals are carried forward. It is to be understood that the disclosed embodiments are merely exemplary of the inventive disclosure, which can be embodied in various forms.

Standpipes are used in buildings to provide a high pressure water source for fire fighters. Although commonly used in high rise buildings, they are also used in other structures. A pressure regulating standpipe valve is used to terminate a standpipe and provide a standardized connection for firefighting equipment, namely hoses. A pressure regulating valve is recommended by groups such as the National Fire Protection Association where the water pressure exceeds 175 psi (e.g. NFPA 14). Such pressures are commonly found where a fire pump is used in a building (as in high rise structures) but can also be found in other structures such as office buildings and manufacturing plants where water may have to be pumped horizontally for great distances.

Figure 8:
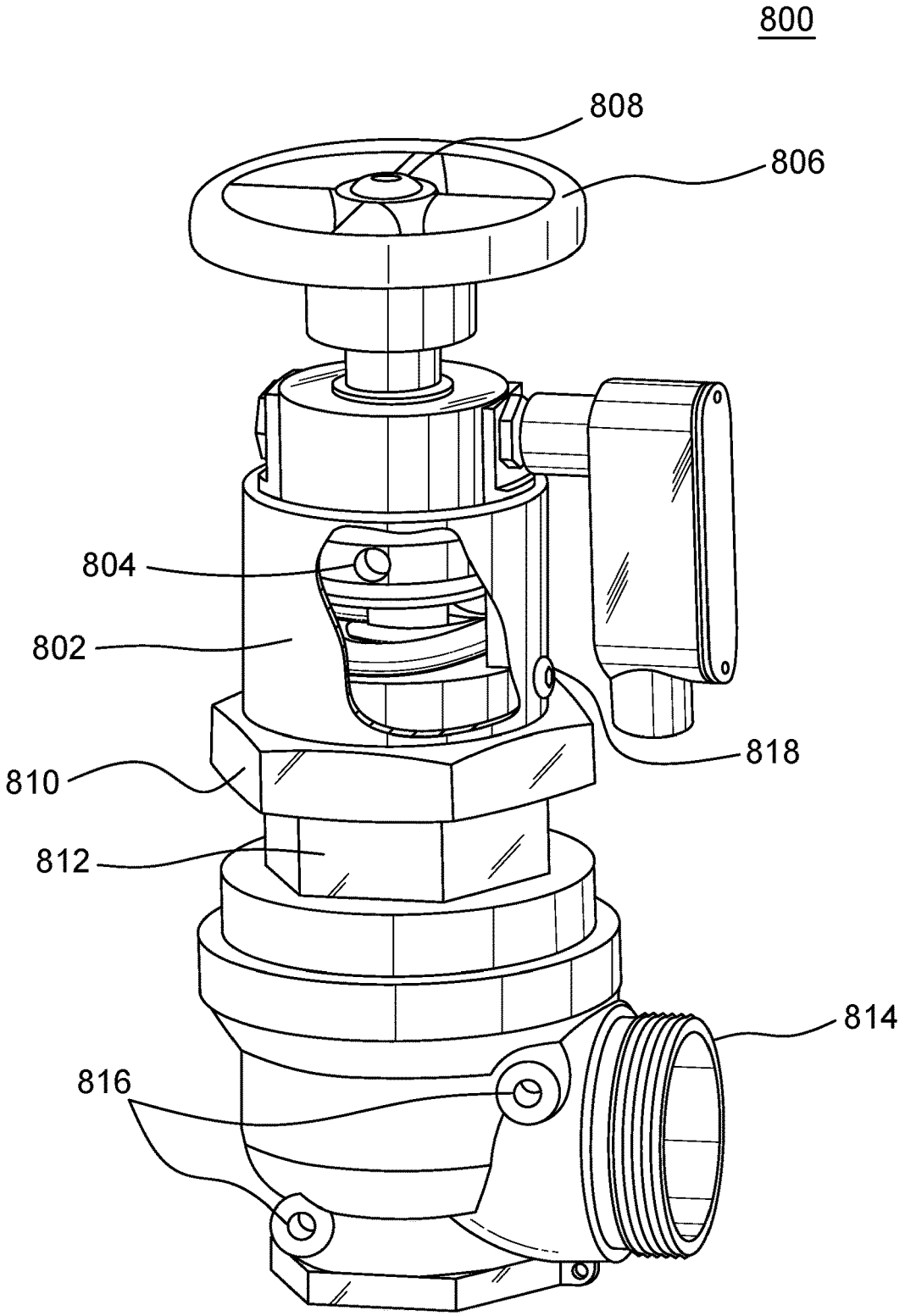
FIG. 8 PRIOR ART
FIG. 8 is a side perspective view of a URFA valve, showing the major components of the valve, as one example of a standpipe configuration which can be adjusted using a standpipe tool in accordance with some embodiments.

FIG. 8 shows one example of a standpipe pressure regulating valve 800, which is known by the acronym "URFA." This type of valve is one that is commonly used in the construction of high rise buildings on standpipes. Several other types of pressure regulating standpipe valves are commonly found in such buildings as well, and have some common features with that shown in FIG. 8. Each floor of a "high rise" building will have one or more standpipes to which firefighters can connect hoses. A pump on lower floors pumps water to the standpipe systems on each floor. As a result of the height difference, there will be a pressure difference at each floor. In order to ensure that a correct water pressure is provided to firefighting equipment when used, the standpipes on each floor are fitted with pressure regulating valves.

It is common for pressure regulating valves to have a wheel handle 806 to open and close the valve mechanism. The valve is kept closed until needed; once a hose is attached, then the valve can be opened. In older stand pipes, the main valve is also used to regulate pressure, but more modern standpipes use a pressure regulating valve that, once the main valve mechanism is opened the pressure regulating mechanism regulates the output pressure. The pressure regulating mechanism can be adjusted, as well.

The wheel handle 806 is typically mounted on a square post 808. Given that these valves are rarely used, it is not uncommon for firefighters to find the wheel handle 806 missing upon arriving at the standpipe. Sometimes they are removed to prevent people from turning the handle without authorization, and sometimes they are taken without authorization. In addition to the wheel handle 806, the valve 800 includes an adjustment ring 804 that has an adjustment hole in the ring 804 that allows adjustment of the pressure regulating mechanism. The ring 804 can be turned using a rod that is inserted into the hole, and then pushing or pulling on the exposed portion of the rod. The ring 804 is typically shielded from tampering with a clear cover 802 that can be removed be removing a tamper resistant screw 818 holding to cover 802 in place. Here the cover 802 is shown with a cut-out, which is provided only to show the ring 804 and is not normally present in the cover 802. Once the cover 802 is removed, and rod or dowel of sufficient strength can be inserted into the adjustment cylinder hole and used as a lever to rotate the adjustment ring to increase or decrease pressure, as needed. The valve 800 also includes a bonnet nut 810 and a lower bonnet 812. A hose can be attached to the hose fitting 814, and pressure can be monitors at pressure gauge taps 816. Earlier valve systems did not include the cover 802 and adjustment ring 804, and instead relied on adjustment of the wheel handle 806.

The standpipe pressure regulating valve 800 is one example of such a valve made by one manufacturer and have one configuration. Other manufacturers make similar pressure regulating valves that are configured and adjusted differently. For example, the 3000 series of standpipe pressure regulating valves made by Zurn Industries are adjusted by removing an outer bonnet and adjusting a nut using, conventionally, a socket wrench. Standpipe pressure regulating valves made by Giacomini S.P.A. in their A200 series of valves are adjusted using a dowel and are similar to that shown in FIG. 8. Other configurations of standpipe pressure regulating valves are likewise adjusted by various nuts, bonnets, wheels, collars, and so on.

FIG. 1 is a side view of a standpipe operations spanner (SOS) multi-tool 100 including an adjustment dowel in the tail of the SOS tool, in accordance with some embodiments. The SOS multi-tool 100 eliminates the need to carry multiple separate tools in order to operate the wide variety of standpipe valves that may be encountered in the field. However, while multi-tools commonly combine various tools that are often used together, in many places firefighters may go years, or decades, without responding to a fire in a high rise building. As such, a multi-tool exclusively for standpipe operations would not be much better than a standpipe tool kit, in that such infrequent use would increase the chance of the tool becoming lost or inadvertently left behind. The SOS multi-tool 100 combines features for standpipe operations with much more common operations to ensure that the SOS multi-tool 100 is frequently used, and therefore when the firefighters respond to a high rise fire, they will be accustomed to bringing the SOS multi-tool 100 with them and will therefore have the ability to adjust and operate various standpipe valves and fixtures when and if the need arises.

The SOS multi-tool 100 includes several major sections. For reference, the SOS multi-tool 100 has a distal end 102 and a proximate end 104 on the opposite end of the SOS multi-tool 100 from the distal end 102. At the proximate end 104 there is a socket section 124 that includes a double-ended socket portion 106. A handle section 126 includes a handle or handle portion 118. Opposite the handle section 126 from the socket section 124 is a lateral coupling section 128 that includes features for coupling to various fittings, nuts, and other mechanical features. The handle 118 defines a handle axis that runs through the handle 118 from the socket portion 124 to the lateral coupling portion 128 in the elongated direction from the proximate end 104 to the distal end 102.

Figure 4:
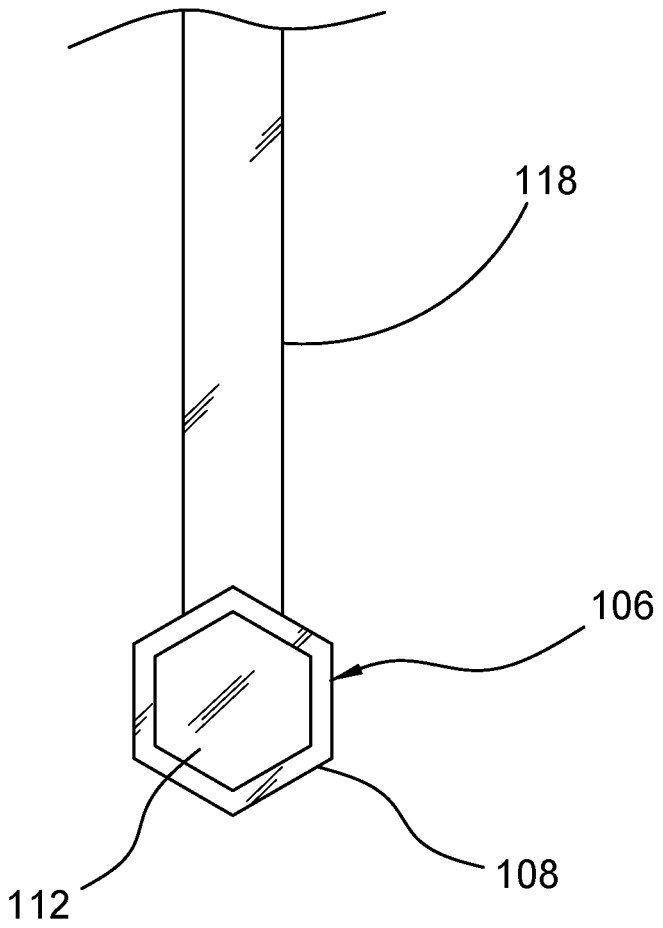
FIG. 4 is a bottom view of a socket end portion of the SOS tool of FIG. 1.

The double-ended socket portion 106 is provided at the proximate end 104 of the SOS multi-tool 100, and has a first end 108 and a second end 110 opposite the first end 108. A socket portion axis 116 is defined from the first end 108 to the second end 110 that is generally perpendicular to an axis of the handle 118. A first socket 112 is formed at the first end 108 to receive a hex-shaped nut or mechanical equivalent of a first size. Likewise, a second socket 114 is formed at the second end 110 to receive a hex-shaped nut or mechanical equivalent of a second size that is different than the first size. For example, the first socket 112 can be for 1 1/16" sized hex nuts, and the second socket 114 can be for 15/16" sized hex nuts. FIG. 4 shows a view of the double-ended socket portion 106 when viewed along the axis 116, looking into end 108, and showing socket 112.

Figure 2:
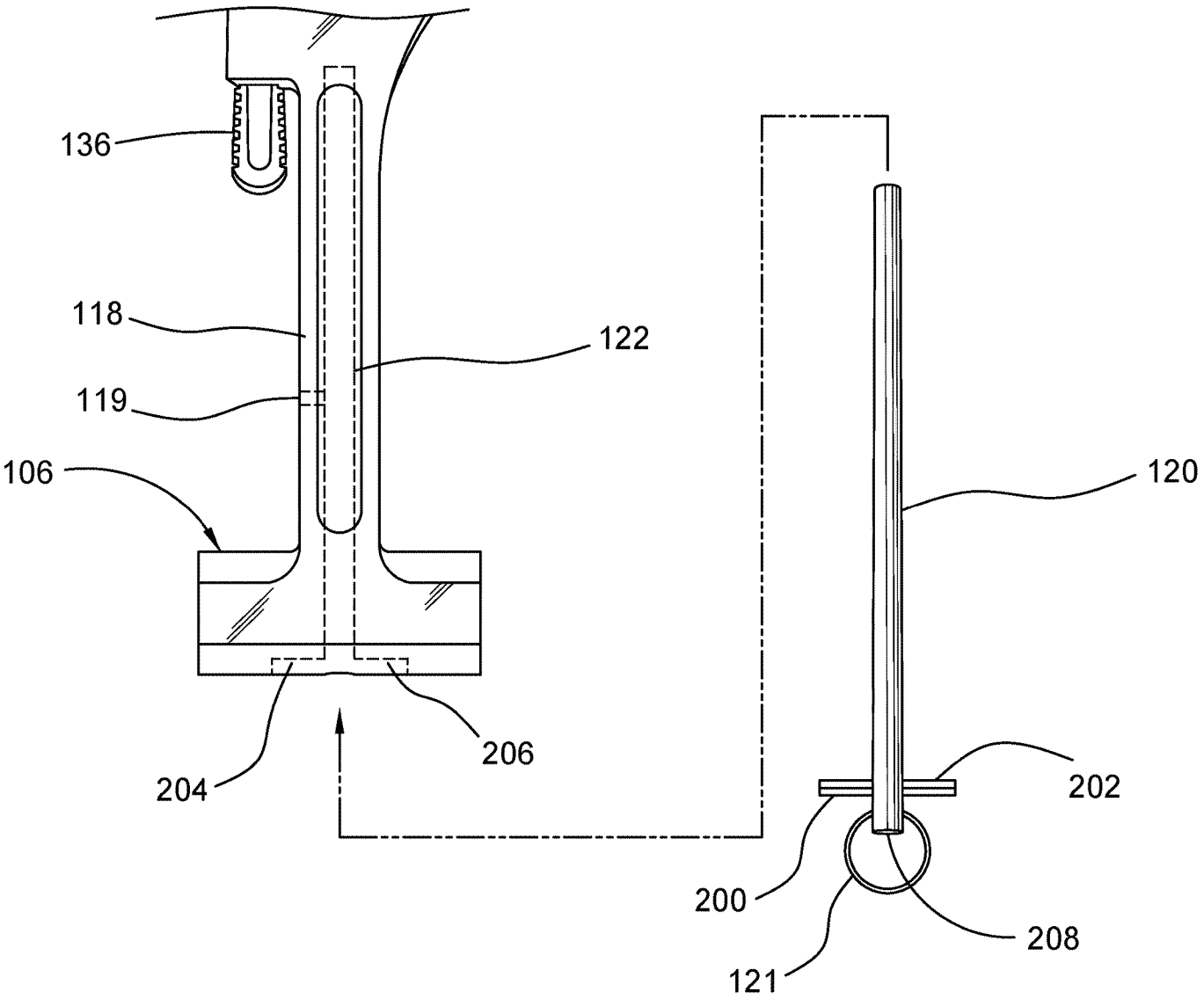
FIG. 2 is a side view of the SOS multi-tool of FIG. 1 showing the adjustment dowel removed from the SOS tool, in accordance with some embodiments.
Figure 3:
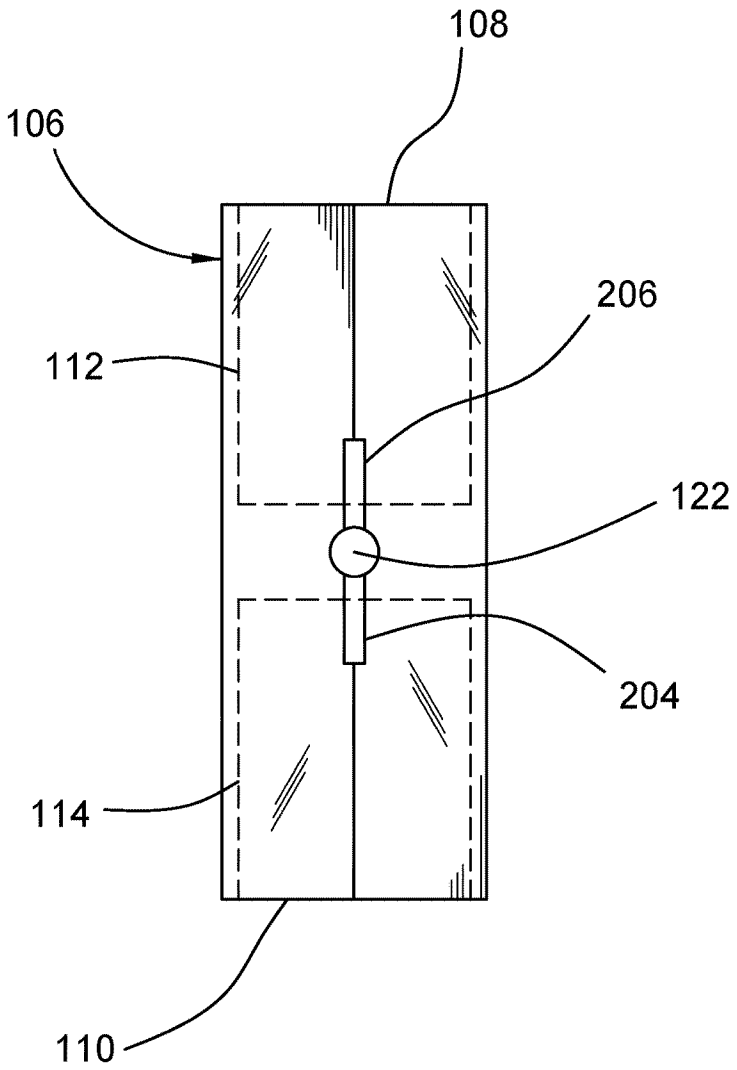
FIG. 3 is an end view of the SOS multi-tool of FIG. 1 showing an opening having a channel in which to hold and retain an adjustment dowel tool, in accordance with some embodiments.

The SOS multi-tool 100 can also include an adjustment rod 120. Starting at the proximate end 104 and running inside and through the socket section 124 into the handle 118 is a channel 122. The channel 122 is a bore inside the handle 118 that runs along and parallel to the handle axis. that is sized to accommodate and hold an adjustment rod 120 and runs substantially perpendicular to the socket axis 116. The adjustment rod 120 can be removed from the handle 118 and used, for example, on ring 804 of a similarly configured pressure reducing valve to that shown in FIG. 8. Specifically, the adjustment rod 120 can be inserted into the adjustment hole in the ring 804 to turn the ring as needed. The rod 120 is shown outside the handle 118 in FIG. 2. At the proximate end 208 of the adjustment rod 120 there are a pair of hex key extensions 200, 202 that extend outward, perpendicular to the axis of the adjustment rod 120. The hex key extensions 200, 202 can be used, for example, to remove the screw 818 to remove the cover 802 over the adjustment ring 804. The hex key extension 200, 202 can be the same size or different sizes. A pull ring 121 can be attached to the proximate end 208 of the adjustment rod 120 to facilitate removal of the adjustment rod 120 from the channel 122. The adjustment rod 120 can be retained in the channel 122 by, for example, a set screw adjustment 119 that provides a detent action against the adjustment rod 120. The hex key extensions 200, 202 can fit in corresponding slots 204, 206. The slots 204, 206 can further be seen in FIG. 3, as well. The slots 204, 206 can accommodate the width of the hex key extensions 200, 202. The handle 118 can also include a recess on each side of the handle 118 to improve grip as well as to lighten the tool 100. The recesses can run along the handle axis.

The handle 118 goes from the double-ended socket portion 106 along the handle section 126 to approximately midway along the distance between the proximate end 104 and the distal end 102. The midpoint where the handle 118 ends can be 40% to 75% of the distance from the proximate end 104 to the distal end 102, and the lateral coupling section 128 begins from the end of the handle section 126 to the distal end 102. The lateral coupling section 128 includes several features for coupling to, and adjusting equipment and fixtures commonly encountered by firefighters. Among the features included is an adjustable spanner having a jaw opening 130 that extends into the lateral coupling section from one side towards the opposite side of the SOS multi-tool 100. The adjustable spanner includes a fixed jaw portion 132 that is adjacent the distal end 102, and an adjustable jaw portion 134, opposite the fixed jaw portion 132 across the jaw opening 130. The adjustable jaw portion 134 is attached to a longitudinal threaded member 136 that is captured in a pair of bosses 138, 140. The longitudinal threaded member is configured to move the adjustable jaw portion 134 in the direction of the fixed jaw portion 132, and is moved by an adjustment ring 146 through which the longitudinal threaded member passes. The adjustment ring 146 in threaded on the inside surface which mates with the threads on the longitudinal threaded member 136. Thus, turning the adjustment ring 146 causes the longitudinal threaded member 136 to move accordingly. The longitudinal threaded member 136 can be captured in bosses 138, 140, which each have a "U" shaped slot through them which are covered by cover plates 142, 144, respectively. The adjustable spanner can be used, for example, on valve bonnets, which can vary in size depending on the valve manufacturer, and/or the particular bonnet location on a valve. The threaded member is arranged such that it moves parallel to the handle axis, and as a result, the fixed jaw portion 132 and adjustable jaw portion 134 present planar surface opposing each other that are substantially perpendicular to the handle axis. Further, the jaw opening 130 can extend to the middle of the tool 100, to a point on the handle axis.

Opposite the adjustable spanner is a valve cap spanner formed with a valve cap spanner opening 148. A first valve cap spanner engagement 150 is located at or adjacent the distal end 102 of the SOS multi-tool 100, and includes a rounded outer portion 151 and an engagement ledge 153. Opposite the valve cap spanner opening 148 is a second valve cap spanner engagement 152. The first and second valve cap spanner engagements 150, 152 are sized and spaced to engage features on a valve cap found on some pressure regulating valves. Further, the first and second valve cap spanner engagements 150, 152 can mate with the lugs on fire hose couplings to allow the fire hose coupling to be turned to either join or detach the hose to/from the pressure regulating valve output coupling.

Adjacent the second hose coupler engagement 152 is a fire hydrant nut wrench 156 that is formed by a pentagonal hole through the lateral coupling section 128. The fire hydrant nut wrench 156 can be oriented to have a flat portion 158 that is parallel to a similar flat portion 154 of the hose coupler spanner near the second hose coupler engagement 152. As the name implies the fire hydrant nut wrench 156 is sized to fit onto a fire hydrant nut to allow a user to turn the fire hydrant nut, opening or closing the fire hydrant valve. A tapering section 164 between the second hose coupler engagement 152 and the handle section 126 can also be parallel to a flat section of the fire hydrant nut wrench 156.

In addition, between the adjustable spanner and the hose coupler spanner can be a plurality of square holes 162 that are sized to engage various sized stems for wheel handles commonly used on standpipe valves. Since it is not uncommon for the wheel handle to be missing, one of the holes 162 can be used in the event that a firefighter encounters a standpipe valve that is missing a wheel handle. The square holes 162 can be arranged along the handle axis, generally along the center of the tool 100 or in a line slightly offset from the handle axis. Further, a gas valve slot 160 is provided in the portion forming the fixed jaw portion 132 at the distal end. The gas valve slot is oval and configured to fit on commonly used and correspondingly shaped natural gas valves so that users can shut off gas lines. In particular, natural gas shutoff valves have a circular valve member that rotates in place, with an elongated raised tab that extends from the valve member to give leverage when turning the valve member. The slot 160 is sized so that the tab will fit into the slot 160, allowing the valve member to be turned by moving the tool 100 so as to rotate about the valve member while the tab is in the slot 160. The gas valve shut off slot 160, square holes 162, and fire hydrant nut wrench 156, in addition to being useful in engaging and turning the corresponding members for which they are sized, also serve to reduce the weight of the tool 100.

The jaw opening 130 of the adjustable spanner, and the valve cap spanner opening 148 face away from each other on opposite sides of the body of the tool 100. As such, they both lay in the same plane of the tool 100. Both the adjustable spanner and the valve cap spanner have one engagement surface positioned adjacent the distal end 102 of the tool 100, and an opposing engagement surface located closer to the middle of the tool 100. This arrangement places the openings 130, 148 closest to the distal end 102 of the tool, opposite the handle 118 to provide the application of torque at the handle 118. The orientation of the socket portion 124 is such that the socket ends 108, 110 are oriented to be in the general plane of the body of the tool 100. Thus socket end 108 is on the same side of the tool as opening 148, and socket end 110 is on the same side of the tool as jaw opening 130. Arranging the features of the tool to be generally aligned in a common plane makes it easier to store the tool.

Figure 5:
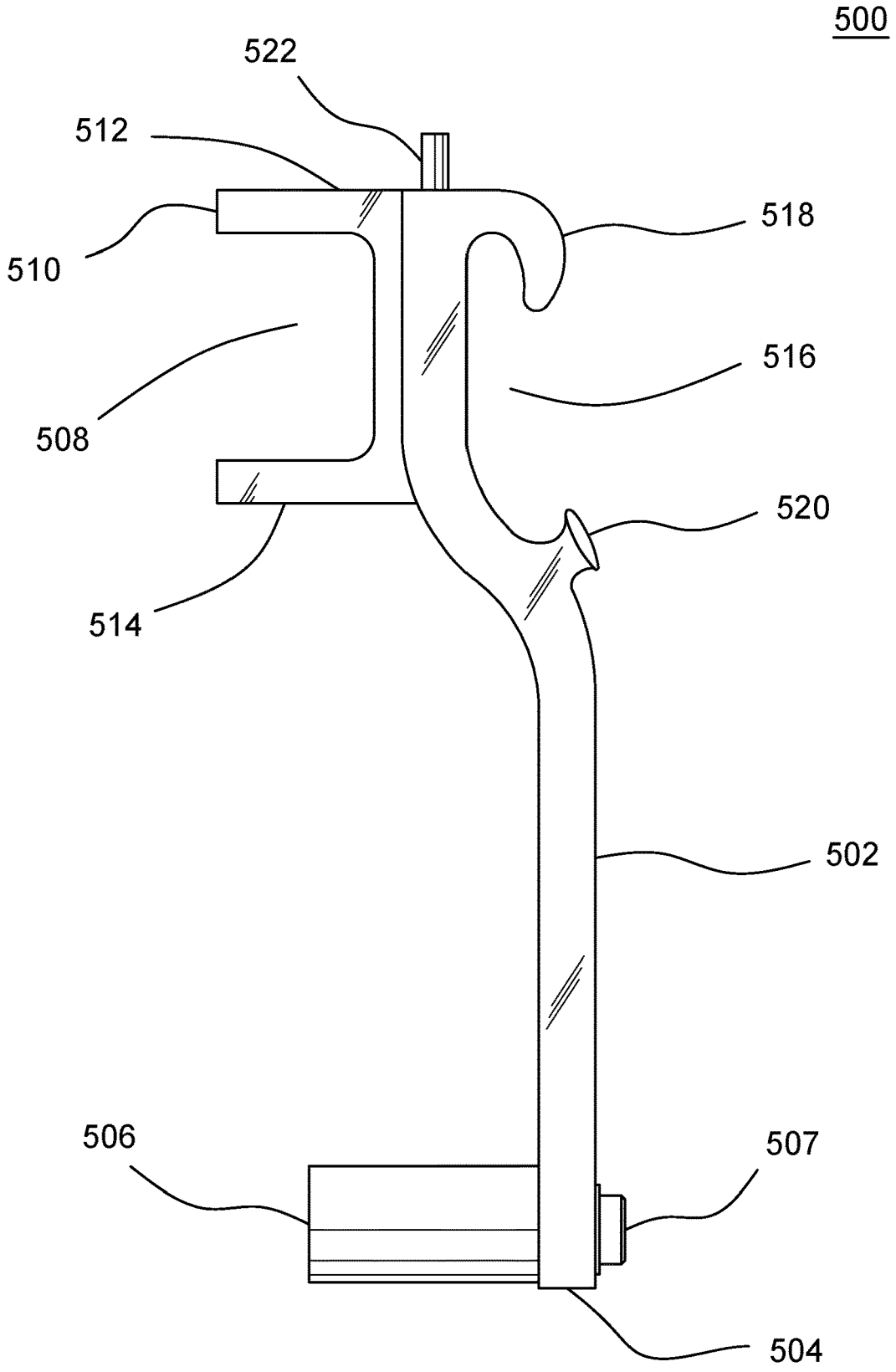
FIG. 5 is a side view of a SOS multi-tool, in accordance with some embodiments.

FIG. 5 is a side view of a SOS multi-tool 500, in accordance with some embodiments. The SOS multi-tool 500 is similar to that shown in FIGS. 1-4, with a reduced set of features. The SOS multi-tool 500 includes a handle 502 having and end at a proximal end 504. A socket 506 can be attached at the proximal end 504 with a bolt 507, which allows a user to change the socket 506 for another socket of a different size, if needed. Near the distal end 512 of the SOS multi-tool 500 is a fixed bonnet spanner having a first fixed jaw portion 510 and a second fixed jaw portion 514 opposite a bonnet opening 508. The distance between the first and second fixed jaw portions 510, 514 is selected to fit a standardized valve bonnet.

Opposite the fixed bonnet spanner is a valve cap spanner that includes a valve cap spanner opening 516 and a first valve cap spanner engagement 518 that is opposite a second valve cap spanner engagement 520 across the opening 516. As with the tool 100 of FIGS. 1-4, the valve cap spanner is configured to engage the lugs or features on a pressure regulating valve cap so as to turn the valve cap.

Further, the SOS multi-tool 500 includes an adjustment dowel 522 the extends from the distal end 512. The adjustment dowel is sized to fit into and engage the hole in an adjustment ring (e.g. 804). As shown here, rather than be removable, the adjustment dowel 522 can be fixed in the distal end 512 of the SOS multi-tool 500.

Figure 6:
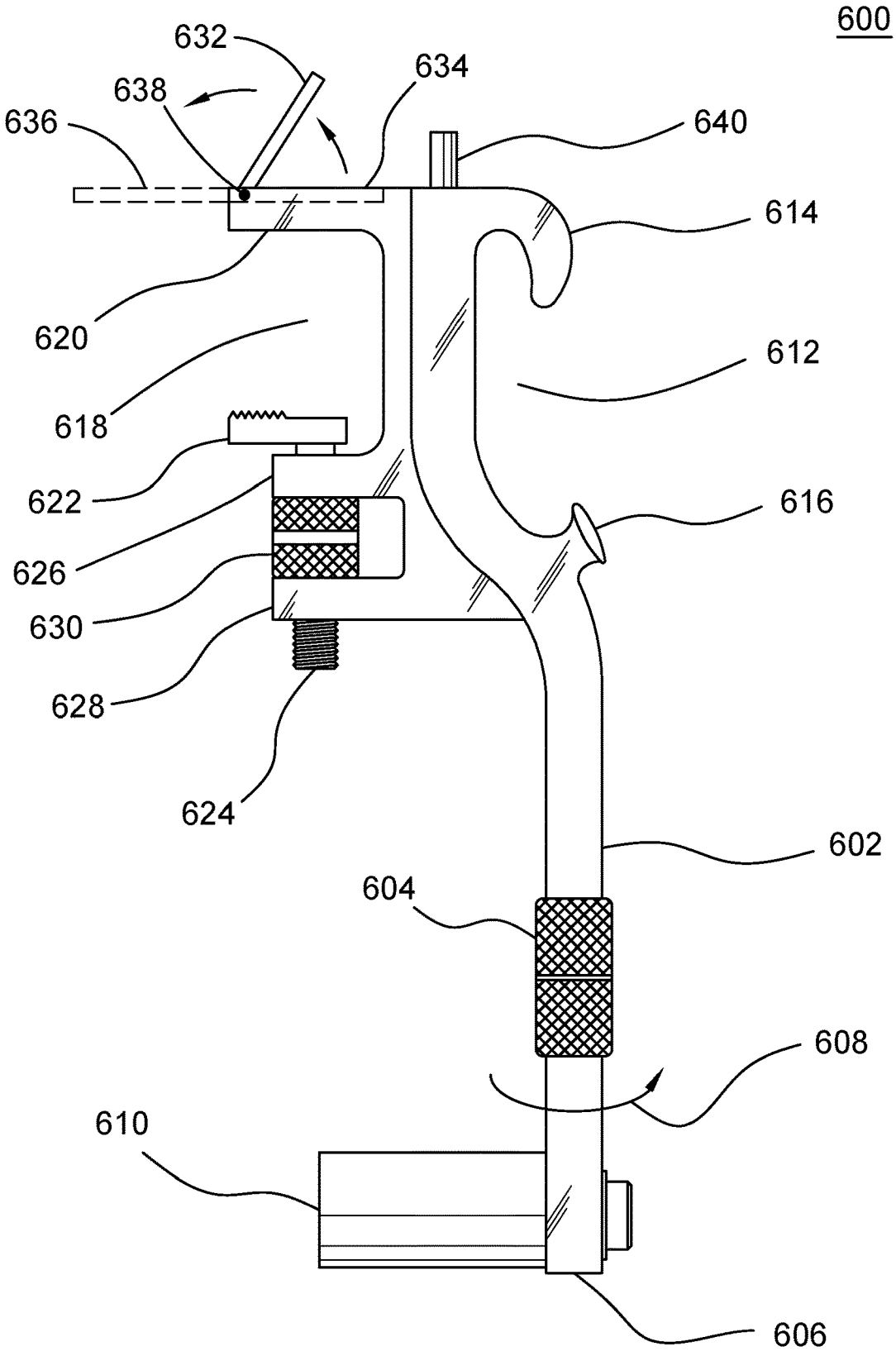
FIG. 6 is a side view of an alternative configuration for an SOS multi-tool, in accordance with some embodiments.

FIG. 6 shows a side view of an SOS multi-tool 600 that is similar to SOS multi-tool 500, in accordance with some embodiments. The handle 602 includes a swivel portion 604 that allows the proximal end 606 of the SOS multi-tool 600 to swivel, as indicated by arrow 608. The swivel portion can have detent features to hold a socket 610 as shown, or to rotate it to face the opposite direction, as needed. The socket 610 can be removable using a bolt, as on SOS multi-tool 500. In both tools 500, 600, the sockets 506, 610 have an axis that is perpendicular to that of the handle 502, 602, respectively.

A valve cap spanner includes a valve cap spanner opening 612 and a first valve cap spanner engagement 614 that is opposite a second valve cap spanner engagement 616 across the opening 612. As with the tool 100 of FIGS. 1-4, the valve cap spanner is configured to engage the lugs on a pressure regulating valve cover of standpipe pressure regulating valves. Opposite the valve cap spanner opening 612 is an adjustable bonnet spanner opening 618. The adjustable bonnet spanner includes a fixed jaw portion 620 and an adjustable jaw portion 622. The adjustable jaw portion 622 is mounted on an end of an elongated threaded member 624 which passes through pair of bosses 626, 628, and is moved by an adjustment ring 630.

On the end of the fixed jaw portion 620, opposite the opening 618, at the distal end of the tool 600, there can be a hex key 632 that can be rotated from a stored position in a slot 634 to and extended position 636. The hex key 632 can be held by a pin 638 about which the hex key 632 can pivot between positions. The hex key is sized to fit, for example, into a cover screw (e.g. 818) that holds a cover over an adjustment ring on a standpipe valve. Once the cover is removed, then a dowel 640 can be used to engage the hole in the adjustment ring (e.g. 804) to allow a user to turn the adjustment ring as needed.

Figure 7:
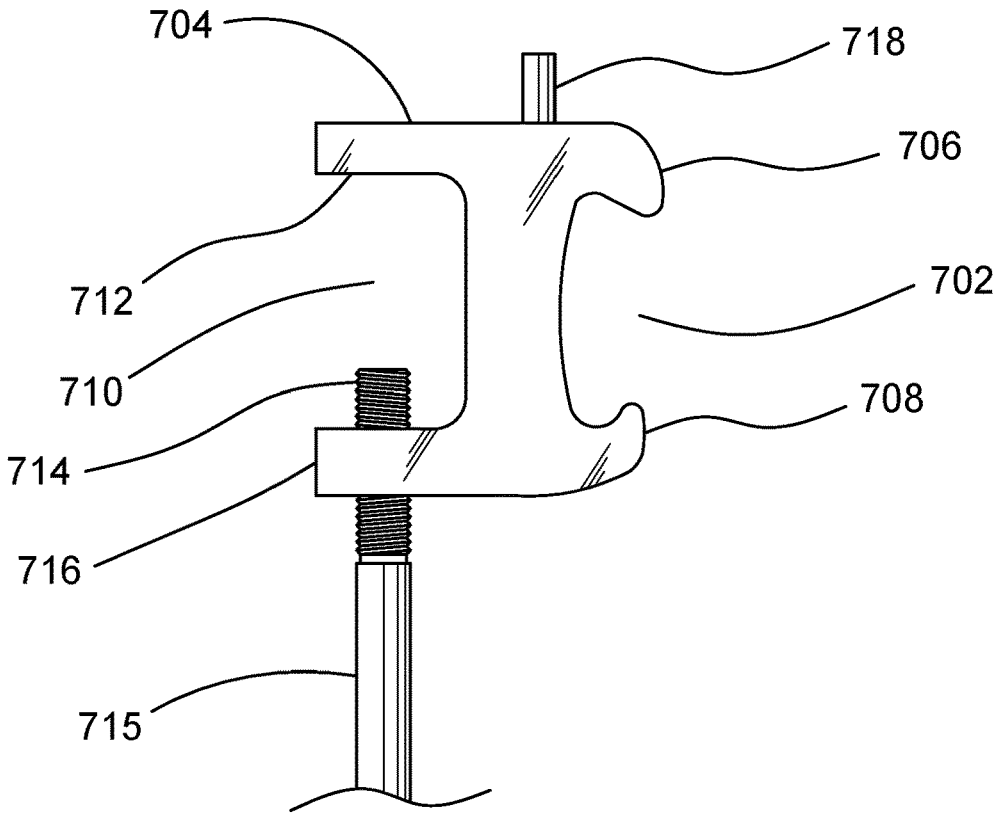
FIG. 7 is side view of a simplified configuration for an SOS multi-tool, in accordance with some embodiments.

FIG. 7 shows a side view of a SOS multi-tool 700 in which the handle 715 is also used as the adjustable jaw portion 714 of an adjustable bonnet spanner feature, in accordance with some embodiments. The adjustable bonnet spanner feature includes an opening 710 flanked by a fixed jaw portion 712 and the adjustable jaw portion 714. Here, only a single boss 816 is used and a portion of the handle 715 is threaded through the boss so that the end of the handle can be moved so that different sized bonnets can be accommodated and engaged in the opening 710, and turned by applying a force on the handle 715. Opposite the adjustable bonnet spanner feature is a valve cap spanner 702 having a first engagement 706 opposite a second engagement 708. The first and second engagements are sized and spaced apart so as to be configured to engage the lugs on a hose coupling, and thereby rotate or turn the hose coupling, as needed. At the distal end 704 there can be an adjustment dowel 718 that is configured for use with an adjustment ring (e.g. 804).

A firefighter multi-tool has been disclosed that address the problem of firefighters having to carry multiple separate tools for the various types of standpipe pressure regulating valves they may encounter in the field, and for other operations they may be required to perform. The multi-tool is formed using a one piece unitary body that can be made of any of a variety of materials. In some embodiments the one-piece unitary body can be machined out of aluminum billet, or forged in aluminum or a similar metal. In some embodiments the body can be made of a rigid polymeric material which can include glass fiber reinforcing. The body can be molded, and then finished with any holes and deburring/smoothing that is needed for features to be finished.

What is claimed is:

1. A standpipe operations spanner tool, comprising:

a monolithic body having a proximate end and a distal end opposite the proximate end, and a fixed length between the proximate end and the fixed end;

a handle formed from the proximate end of the monolithic body in a direction towards the distal end, a handle axis being defined by the handle;

at least one hex socket, located at the proximate end of the monolithic body and joined to the handle, that is configured to fit onto a standpipe pressure regulator of a first type, wherein the at least one hex socket is oriented perpendicular to the handle axis;

a spanner adjacent the distal end of the monolithic body on a first side of the monolithic body and having a spanner jaw opening oriented along the monolithic body; and an adjustable bonnet spanner having an adjustable jaw opening opposite the spanner on the monolithic body, and having a fixed jaw portion adjacent the distal end of the monolithic body, and an adjustable jaw portion mounted on the monolithic body opposite the fixed jaw portion across the adjustable jaw opening and between the fixed jaw portion and the proximate end of the monolithic body, wherein the adjustable jaw portion of the adjustable bonnet spanner comprises an elongated threaded member captured by a first monolithic boss and a second monolithic boss, wherein the elongated threaded member is oriented such that an axis of the elongated threaded member is parallel to the handle axis, an adjustment ring is disposed over the elongated threaded member between the first monolithic boss and the second monolithic boss, and wherein the first monolithic boss and the second monolithic boss are each fixed portions of the monolithic body that extend outward in a direction generally perpendicular to the handle axis.

2. The standpipe operations spanner tool of claim 1, wherein the spanner is a valve cap spanner.

3. The standpipe operations spanner tool of claim 1, wherein the spanner is a hose fitting spanner.

4. The standpipe operations spanner of claim 1, wherein the proximate end of the handle includes a cross member having a hex socket, and wherein the cross member can be rotated about the handle axis.

5. The standpipe operations spanner of claim 1, wherein the hex socket is oriented is double ended, wherein a first end is first size hex socket and a second end is a second side hex socket.

6. The standpipe operations spanner of claim 5, wherein the proximate end of the handle is rotatable about the handle axis and the hex socket can be oriented in either of at least two positions about the handle axis.

7. The standpipe operations spanner of claim 1, further comprising:

an adjustment dowel disposed at the distal end of the handle and that is configured to fit into an adjustment hole of an adjustment ring of a standpipe valve of a second type, and which is oriented along the handle axis.

8. The standpipe operations spanner of claim 1, further comprising a gas shut off slot formed through the monolithic body between the fixed jaw and the distal end.

9. A firefighter multi-tool, comprising:

the firefighter tool having an elongated monolithic body having a proximate end and a distal end the elongated monolithic body having a fixed length from the proximate end and the distal end;

a double-ended socket portion formed at the proximate end of the elongated monolithic body, and having a first socket at a first end and a second socket at a second end opposite the first end, and a socket portion axis defined through the double-ended socket portion from the first end to the second end;

a handle formed from the double-ended socket portion at a side of the double-ended socket portion midway between the first end and the second end to a midpoint of the elongated monolithic body along a handle axis that is perpendicular to the socket portion axis, and which extends in a direction from the proximate end to the distal end of the elongated monolithic body;

a lateral coupling section including, on a first side of the lateral coupling section, an adjustable bonnet spanner having fixed jaw portion adjacent the distal end and an adjustable jaw located between the fixed jaw portion and the proximate end of the elongated monolithic body, wherein the adjustable jaw portion of the adjustable bonnet spanner comprises an elongated threaded member captured by a first monolithic boss and a second monolithic boss, wherein the elongated threaded member is oriented such that an axis of the elongated threaded member is parallel to the handle axis, an adjustment ring is disposed over the elongated threaded member between the first monolithic boss and the second monolithic boss, and wherein the first monolithic boss and the second monolithic boss are each fixed portions of the elongated monolithic body that extend outward in a direction generally perpendicular to the handle axis; and a valve cap spanner opposite adjustable spanner on the lateral coupling section having a first engagement adjacent the distal end.

10. The firefighter multi-tool of claim 9, further comprising a fire hydrant nut wrench disposed in the lateral coupling section formed and pentagonal opening through the lateral coupling section between the adjustable spanner and the valve cap spanner.

11. The firefighter multi-tool of claim 9, further comprising an adjustment rod disposed in a bore along the handle axis, wherein the bore extends into the handle from the proximate end and through the double-ended socket portion.

12. The firefighter multi-tool of claim 11, further comprising a pair of hex key extensions that extend outward, perpendicular to an axis of the adjustment rod, at an end of the adjustment rod and further comprising a pair of slots formed in the elongated monolithic body at the proximate end that are each configured to receive a respective one of the pair of hex key extensions, wherein a first one of the pair of slots is formed from the bore along the first socket and a second one of the pair of slot is formed from the bore along the second socket.

13. The firefighter multi-tool of claim 12, wherein the double-ended socket portion includes a pair of slots extending from the bore at the proximate end in which the pair of hex key extension fit.

14. A standpipe operations spanner tool, comprising:

an elongated monolithic body having a proximate end and a distal end opposite the proximate end, the elongated monolithic body having a fixed length between the proximate end and the fixed end;

the elongated monolithic body having a socket portion formed at the proximate end and defining a socket portion axis, the socket portion having at least one hex socket oriented in a direction of the socket portion axis, wherein the at least one hex socket is sized to engage an adjustment nut of a standpipe pressure regulating valve;

the elongated monolithic body having a handle portion formed adjoining the socket portion and extending to a midpoint of the elongated monolithic body along a handle axis that is perpendicular to the socket portion axis; and the elongated monolithic body having a lateral coupling portion formed adjoining the handle portion at the midpoint and extending to the distal end of the elongated monolithic body in a direction of the handle axis and including an adjustable bonnet spanner having fixed jaw portion adjacent the distal end of the elongated monolithic body, and an adjustable jaw portion located between the fixed jaw portion and the proximate end of the elongated monolithic body, wherein the adjustable jaw portion of the adjustable bonnet spanner comprises an elongated threaded member captured by a first monolithic boss and a second monolithic boss, wherein the elongated threaded member is oriented such that an axis of the elongated threaded member is parallel to the handle axis, an adjustment ring is disposed over the elongated threaded member between the first monolithic boss and the second monolithic boss, and wherein the first monolithic boss and the second monolithic boss are each fixed portions of the elongated monolithic body that extend outward in a direction generally perpendicular to the handle axis.

15. The standpipe operations spanner tool of claim 14, wherein the socket portion comprises a first socket at a first end and a second socket at a second end opposite the first end, wherein the socket axis passes through the socket portion from the first end to the second end.

16. The standpipe operations spanner tool of claim 14, wherein the lateral coupling section further comprises a valve cap spanner positioned on the lateral coupling section opposite the adjustable bonnet spanner.

17. The standpipe operations spanner tool of claim 16 wherein the lateral coupling section further comprises:

a gas valve shut off slot formed through the body between the distal end of the elongated monolithic body and the fixed jaw of the adjustable bonnet spanner and having a length oriented perpendicular to the handle axis;

at least one square hole formed through the elongated monolithic body between the adjustable bonnet spanner and the valve cap spanner; and a regular pentagonal socket formed through the elongated monolithic body between the adjustable bonnet spanner and the valve cap spanner, and between the handle portion and the at least one square hole, the pentagonal socket being sized to fit on a fire hydrant nut.

18. The standpipe operations spanner tool of claim 14, further comprising an adjustment rod removable disposed in a channel running through the socket portion at the proximate end of the elongated monolithic body and along the handle axis into the handle portion, the adjustment rod having a pair of hex key extensions that extend outward, perpendicular to an axis of the adjustment rod, at an end of the adjustment rod and further comprising a pair of slots formed in the firefighter tool at the proximate end that are each configured to receive a respective one of the pair of hex key extensions, wherein a first one of the pair of slots is formed from the bore along the first socket and a second one of the pair of slot is formed from the bore along the second socket.

* * * * *